US006692349B1

(12) United States Patent
Brinkerhoff et al.

(10) Patent No.: US 6,692,349 B1
(45) Date of Patent: Feb. 17, 2004

(54) COMPUTER CONTROLLED AIR VENT

(75) Inventors: Mark Duncan Brinkerhoff, San Jose, CA (US); Thomas Keith Geraty, San Jose, CA (US)

(73) Assignee: Fusion Design, Inc., Campbell, CA (US)

( * ) Notice: Subject to any disclaimer, the term of this patent is extended or adjusted under 35 U.S.C. 154(b) by 0 days.

(21) Appl. No.: 10/166,969

(22) Filed: Jun. 10, 2002

Related U.S. Application Data

(60) Provisional application No. 60/296,743, filed on Jun. 11, 2001.

(51) Int. Cl.[7] ..... F24F 7/00
(52) U.S. Cl. ..... 454/256; 236/51
(58) Field of Search ..... 454/256, 333; 237/2 A, 8 A; 236/49.1, 51

(56) References Cited

U.S. PATENT DOCUMENTS

| | | | | |
|---|---|---|---|---|
| 4,150,788 A | | 4/1979 | Matsumoto et al. | |
| 4,273,283 A | | 6/1981 | Edwards | |
| 4,445,637 A | | 5/1984 | Hedrick | |
| 4,945,822 A | | 8/1990 | Hicks et al. | |
| 4,969,508 A | * | 11/1990 | Tate et al. | 165/209 |
| 4,997,030 A | | 3/1991 | Goto et al. | |
| 5,004,149 A | | 4/1991 | Narikiyo | |
| 5,014,610 A | | 5/1991 | Twito | |
| 5,312,298 A | | 5/1994 | Myers | |
| 5,390,206 A | * | 2/1995 | Rein et al. | 375/130 |
| 5,441,451 A | | 8/1995 | Jeung | |
| 5,449,143 A | | 9/1995 | Hur | |
| 5,704,832 A | | 1/1998 | Borrell | |
| 5,833,134 A | | 11/1998 | Ho et al. | |
| 5,984,775 A | | 11/1999 | Lee et al. | |
| 6,050,892 A | | 4/2000 | Sodec | |
| 6,287,050 B1 | | 9/2001 | Montgomery et al. | |
| 6,338,677 B1 | | 1/2002 | White | |

* cited by examiner

*Primary Examiner*—Derek Boles
(74) *Attorney, Agent, or Firm*—Blakely, Sokoloff, Taylor & Zafman LLP

(57) ABSTRACT

A computer-controlled air vent and methods of using the same are disclosed herein. In one embodiment, the computer-controlled air vent includes: a top plate; a base connected to the top plate; a component housing connected to the top plate and to the base; a plurality of louvers rotatably positioned within the base; a force generating means connected to the louvers to rotate them between an open position and a closed position; a temperature sensor to sense an indoor temperature; a computer processor; a memory; a wireless transceiver; a bus to connect the processor and the memory; and a remote control device to control the opening and closing of the louvers.

11 Claims, 14 Drawing Sheets

COMPUTER CONTROLLED AIR VENT

PRIORITY

This application claims the benefit of U.S. Provisional Application No. 60/296,743, filed Jun. 11, 2001.

FIELD OF THE INVENTION

This invention relates generally to heating, ventilation, and air conditioning (HVAC) systems and more particularly to computer-controlled air vents.

DISCUSSION OF PRIOR ART

In residential HVAC systems it is not customary to install a HVAC control thermostat in each individual room of a house, and therefore it is difficult to maintain a uniform temperature environment in all rooms. Typically, the only room having a controlled temperature environment is the room in which the control thermostat is located. Frequently, a system using a single control thermostat results in "cold" rooms or "hot" rooms in other parts of the building, due to exposure, location, heating duct configuration, and other causes. In order to heat a "cold" room, the single control thermostat is typically set at a higher level, but this increases the temperature in the other rooms that are normally at a higher level. In order to cool a "hot" room, the single control thermostat is typically set a lower level, but this decreases the temperature in the other rooms that are normally at a lower level. As a means of compensating for these temperature differentials, the standard air vents in each room are equipped with manual mechanical louver arrangements which will control the flow of air from 0% to 100%. However, any manual adjustments made to the air vents are static once made. Thus, although a register in a "hot" room could be manually adjusted to restrict the flow of air passing through it, this adjustment could result in the same room becoming a "cold" space unless the vent is later manually adjusted to the open position.

A particular problem faced by conventional HVAC systems is that the individual rooms of a building have different volumes, and thus are heated or cooled at different rates. For example, in a system having a small room and a large room, the small room will heat and cool more quickly than the large room. When the central thermostat is adjusted to a target temperature, the smaller room typically achieves the target temperature before the larger room, but because the manual air vents remain open, warm or cool air that could be used to heat or cool the larger room continues to pour into the small room, thereby wasting energy and causing overheating or overcooling. Consequently, the smaller room feels stifling or frigid.

An inherent problem with conventional HVAC systems is that they do not provide the proper amount of heating and cooling to all rooms proportionately. Additionally, such systems do not account for the changing variables that affect the thermal management needs of each room. These variables include people and equipment changes, external sun or snow loading, rain, daytime vs. nighttime needs, weekend vs. weekday needs, etc. It is possible to accommodate these changes manually by repeatedly opening and closing the air vents throughout the day, but such procedures are too time-consuming and labor-intensive to be practical or cost-effective. Consequently, uneven heating and cooling of the facility results, with smaller rooms heating or cooling faster (and to a greater degree) than larger rooms. As a result, more energy is consumed than is needed to maintain a comfortable environment.

The shortcomings of residential HVAC systems are more acute in commercial settings, where the cost of heating or cooling small to large buildings significantly impacts the profit margins of the business enterprises that occupy these buildings. The problem is somewhat alleviated in large commercial buildings, which are built to include elaborate cost-saving lighting, heating and cooling control systems that offer significant energy savings. Such systems typically include multiple HVAC zones, with each zone covering one or more workspaces within the building. In smaller business settings most heating and ventilation systems employ a single zone HVAC unit to supply conditioned, heated or cooled air to more than one distinct zone or room. However, in both large and small buildings, each room or zone may have different comfort requirements due to occupancy differences, individual preferences, and exterior heat and cooling load differences. The smaller business types of systems are referred to as single zone HVAC units because they are controlled from one centrally located OFF/ON thermostat controller. In a building having multiple zones that have different heating and cooling requirements, there is often no one, good representative location for the installation of a thermostat controller.

As in residential houses, smaller workspaces in commercial buildings tend to heat and cool faster than larger workspaces. This problem is exacerbated because commercial air vents typically do not include manual adjustment means. Additionally, the air vents found in commercial buildings are often located in the ceilings, which, unlike the ceilings in residential houses, may be approximately 8 feet or more above the floor. Consequently, individuals are often not able to adjust the airflow within their personal workspaces. In cases where manual adjustment means are provided, adjusting the air vents typically necessitates standing on a chair, desk, or ladder, which is inefficient and potentially hazardous.

The prior art provides a number of noteworthy attempts to create systems which address the problems of controlling the diverse needs of single and multi-zoned HVAC systems. Some of these systems describe remote controllers for starting and stopping an HVAC apparatus. Other systems describe wax motors and bi-metallic elements that close louvers disposed within an air register as the temperature of a room increases, and that open the louvers as the temperature of the room decreases. Further systems describe motors connected to louvers for opening and closing the louvers in response to control signals received from a centrally mounted controller. Still other systems describe variable air valve (VAV) units installed within the ducts of a HVAC system and hard-wired to a central remote controller. Yet other systems describe wireless remote thermostats that take over the temperature sensing and control functions of a central thermostat. However, the above systems are disadvantageous on a number of levels.

Firstly, the motorized air registers tend to be mechanically complex and difficult to install. Additionally, the air registers tend not to be computer-controlled. Furthermore, the motors are typically hard wired to a power source. Secondly, the remote control units tend to control the HVAC unit itself and not the individual air registers. Thirdly, the bi-metallic elements tend to open the air louvers as a room cools, thereby resulting in overcooling. Fourthly, where remote controllers are used to start and stop an HVAC unit, uneven cooling results throughout each HVAC zone because the registers within each zone are often manually controlled.

SUMMARY OF THE INVENTION

A computer-controlled air vent and methods of using the same are disclosed. In one embodiment, the computer-controlled air vent includes: a top plate; a base connected to the top plate; a component housing connected to the top plate and to the base; a plurality of louvers rotatably positioned within the base; a force-generating means connected to the louvers to rotate them between an open position and a closed position; a temperature sensor to sense an air temperature; a computer processor; a memory; a wireless transceiver; a bus to connect the processor, the wireless transceiver, and the memory; and a remote control device to control the opening and closing of the louvers.

BRIEF DESCRIPTION OF THE DRAWINGS

The present invention is illustrated by way of example, and not limitation, in the figures of the accompanying drawings, in which:

FIG. 6 is a cut-away side view of the computer-controlled air vent of FIG. 3, according to one embodiment of the invention;

DETAILED DESCRIPTION OF THE INVENTION

Figure 1:
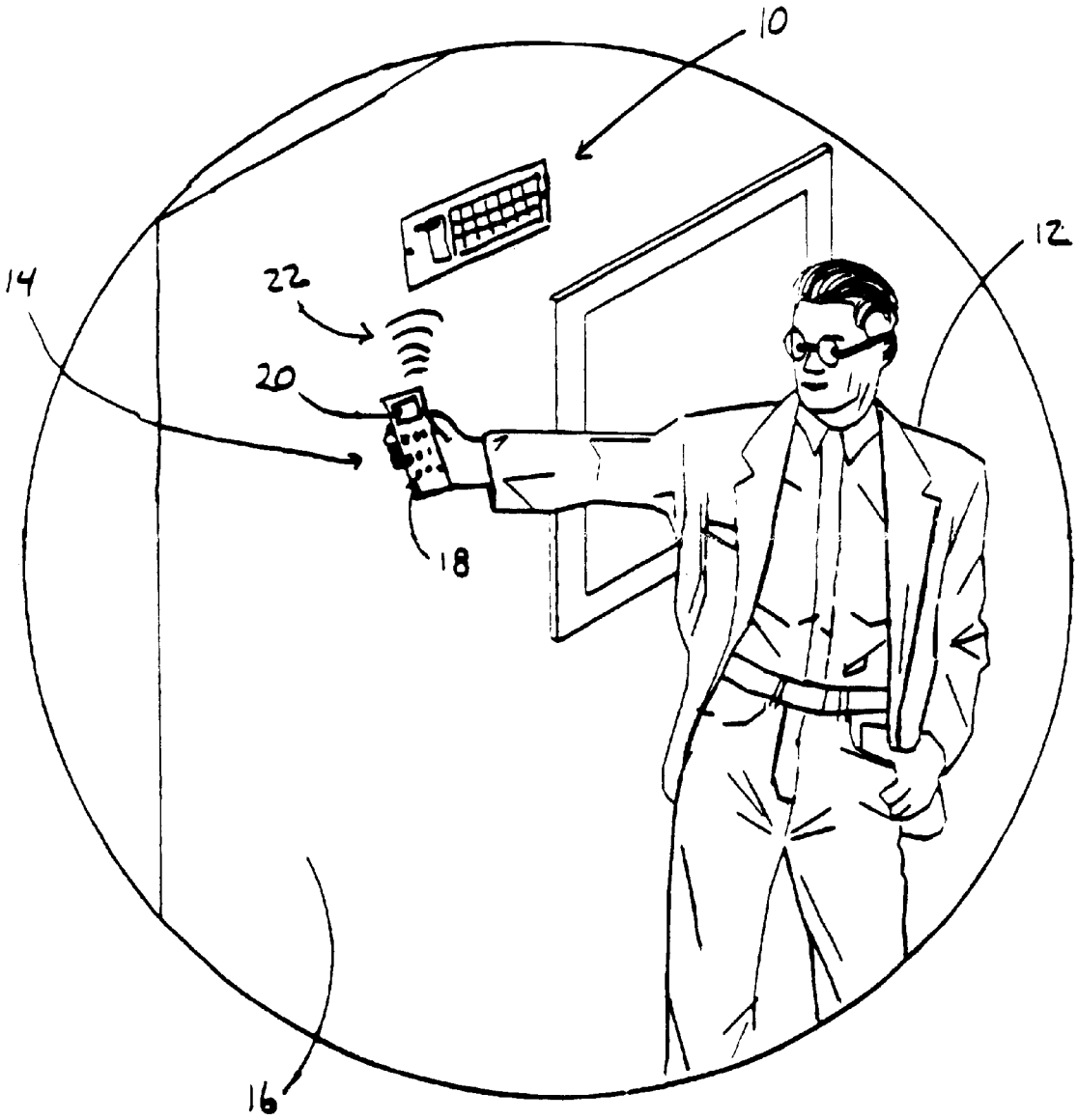
FIG. 1A is a diagram illustrating the use of a computer-controlled air vent, according to one embodiment of the invention.

FIG. 1 illustrates the use of a computer-controlled air vent 10 used to cool or heat a structure 16, according to one embodiment of the invention. The structure 16 is a residential or commercial building that includes a plurality of individual rooms, as well as one or more HVAC zones. Each HVAC zone includes one of the individual rooms, and each room includes one or more air duct outlets through which conditioned hot or cool air can flow to heat or cool the room as desired. One or more of the air duct outlets within a room may be equipped with the automatic computer-controlled air vent 10 shown in FIG. 1. As further described herein, the computer-controlled air vent 10 is remotely operated by a handheld or wall-mounted controller 14 located in the same room as the vent. The computer-controlled air vent 10 includes a force generating means and a renewable power supply that are self-contained within the air vent itself.

Additionally, the computer-controlled air vent 10 is manufactured in a variety of sizes and configurations for fast and easy installation over existing air duct outlets in both residential and commercial buildings. The computer-controlled air vent 10 is made of a rigid material, such as plastic, wood, or metal, that can include a variety of colors and cosmetic appearances. Moreover, the computer-controlled air vent 10 can be manufactured to include a removable front plate. In such a configuration, the front plate can be removed for cleaning or swapped with a different front plate having the same or different color and/or aesthetic appearance.

Although the computer-controlled air vent 10 may be installed in every room of a structure 16, the air vent 10 is typically only installed in one more of the smaller rooms because these rooms tend to heat and cool faster than the larger rooms. As the HVAC unit blows conditioned hot or cool air into the one or more rooms that form an HVAC zone, the smaller room will reach a target temperature sooner than the larger rooms. The wireless remote controller 14, which may be located at virtually any point within the smaller room, compares the room's ambient air temperature with the target temperature that was input into the wireless remote controller 14 by a user of the device. When the room's ambient air temperature approximately matches the target temperature, the remote controller 14 signals a force providing means disposed within the air vent 10 to close the vent's air louvers. Closing the louvers of course restricts the volume of conditioned air flowing through the air vent 10 and allows a greater portion of the available air to be diverted to other channels in the HVAC system. In this manner, more air is then provided to the larger rooms, which consequently heat or cool faster than would otherwise be the case. This, in turn, translates to energy savings and decreased operating costs because the HVAC unit now operates for shorter periods of time.

The remote controller 14 is manufactured such that it can be held in the palm of a user's hand, positioned on a flat surface such as a desk, shelf, or table, or removably attached to a wall bracket. The remote controller 14 is powered by disposable or rechargeable batteries and includes various input buttons 18, an optional display screen 20, and a wireless radio-frequency transceiver, which is used to transmit control signals to the air vent 10. The remote controller 14 does not replace nor control the central thermostat typically associated with the HVAC system. Rather, the central thermostat operates as normal. The remote controller 14 simply operates to monitor a user-specific target temperature for the room in which it is placed and to divert conditioned air to other channels of the HVAC system when the room's target temperature is reached, by signaling the force generating means to close the vent's air louvers. Furthermore, the remote controller 14 does not turn the HVAC unit ON or OFF. Instead, the HVAC unit takes all of its ON and OFF commands from the central thermostat as normal. Typically, the remote controller 14 will control only one corresponding air vent 10. However, in some applications, such as where a single room includes two or more air vents 10, a single remote controller 14 can be configured to control multiple air vents 10.

To prevent a remote controller 14 in one room from controlling the operation of an air vent 10 in another room, each remote controller/air vent pair may have a unique communications channel or communication code (such as is common with automatic garage door openers). To prevent a remote controller 14 connected to a corresponding air vent 10 from measuring the temperature in another room and controlling the air vent accordingly when the remote controller 14 transported to a room different than the one where the air vent is located, the remote controller's transceiver may be configured to have a limited operating range. For Bluetooth implementations, the remote is configured to send out a beacon and get a response from whichever vent is in the same room as the remote. In such an embodiment, the remote "knows" where it is and which vent to control.

Alternatively, a remote controller 14 positioned in the same room as its corresponding air vent 10, may be connected to a computer controlled network such as a LAN or WAN and operated by a user 12 at a remote location. As will be further described later, this embodiment is especially useful in conserving energy. For example, using this embodiment, a user 12 returning home late from work can program the remote controller 14 over the Internet or other network to delay the opening or closing of the air louvers to achieve the target temperature. Similarly, managers of commercial buildings can use the Internet or other network to program multiple remote controllers 14 installed in structures 16 located at distant geographical locations. Additionally, power companies can use embodiments of the present invention to prevent blackouts and other power shortages.

The remote controller 14 is assembled from components known to persons of ordinary skill in the art using processes and techniques known in the art. Consequently, the various technical aspects of its product design and manufacture are not detailed here in order not to obscure the invention unnecessarily. The particular electrical and digital architecture of the remote controller 14 may vary according to the various commercial or residential application for which it is designed. In passing, however, the housing of the remote controller 14 is manufactured from a rigid material, such as wood, plastic, metal, and so forth, designed to have a particular color and/or pleasing aesthetic appearance.

The remote controller 14 may execute a computer software program, which causes a graphical user interface (GUI) to be displayed in the display device 53. From the information displayed on the GUI, a user can select a "manual override" function, an "on" function, an "off" function, a "day" function, a "week" function, a "time of day" function, and a "target temperature" function. Selecting one of these functions causes a command signal to be output to a digital to analog (D/A) converter or to a wireless transceiver located within the housing of the remote controller 14, which then transmits to the air vent 10 the proper signal sequence needed to implement the command over the wireless channel 22. By selecting one or more of the "day", "week", "time of day", and "target temperature" functions, a user 12 can program the remote controller 14 to operate at different time periods. This feature is especially useful where a room is used only during certain portions of a day or week, such as only during business hours Monday–Friday, or only on weekends.

The remote controller 14 may also include a temperature sensing device in the form of a thermocouple or thermistor that senses the ambient air temperature of the room in which the remote controller 14 is located. This is particularly advantageous because the temperature of a particular room often differs from the temperature sensed by the distant HVAC thermostat. Additionally, the temperatures can differ significantly from one portion of the room to the next. For example, areas of the room above approximately shoulder height tend to be warmer than lower areas. Thus, a temperature that may be comfortable for persons standing within the room may be too cool for persons seated at desks. By making the remote controller 14 portable, it is possible to accurately sense the temperature at a particular area of the room, and to adjust the airflow accordingly. Thus, for example, a user sitting at a desk may place the remote controller 14 on the desktop, whereas a user standing for long periods, such as a dancer or an artist, may detachably mount the remote controller at approximately shoulder height on a wall of the room. Alternatively, the temperature sensing device can be located in the air vent 10 itself. If the air vent 10 is located near or in the ceiling or near or in the floor, algorithms known in the art can be used to calculate the temperature felt by a user standing or sitting in the room.

Figure 2:
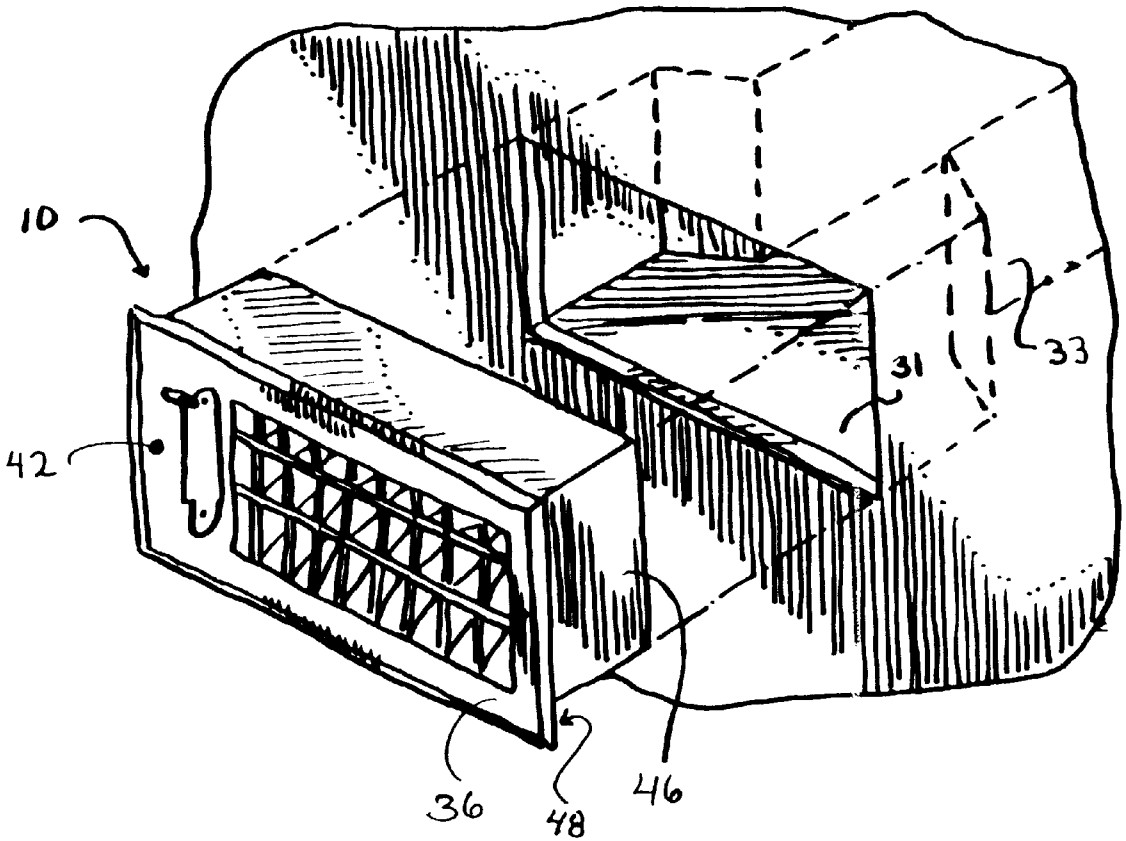
FIG. 2 is a diagram illustrating installation of a computer-controlled air vent into an air duct outlet of a conventional HVAC system, according to one embodiment of the invention.

FIG. 2 illustrates how one embodiment of a computer-controlled air vent 10 is retrofitted into an existing air duct outlet 31 of a conventional residential HVAC air duct 33. Specifically, the base 46 slides within the interior of the air duct outlet 31, and the face plate (hereinafter, top plate) 36 removably attaches either to a flange projecting from the perimeter of the air duct outlet vent 31 or to the wall, floor, or ceiling through which the air duct outlet 31 protrudes. When properly positioned, the top plate 36 substantially covers and conceals the outlet vent 31. Moreover, the top plate 36 is of a size such that its flange 48 extends beyond a perimeter of the outlet vent 31 to maintain a substantially flush appearance without permitting the base 46 from being inserted too far into the outlet vent 31. Screws or other fasteners inserted through the recesses 42 centrally formed at either end of the top plate 36 are used to secure the air vent 10 in place. It will be appreciated that the actual dimensions of the air vent 10 differ according to whether the air vent 10 is to be used in a residential or a commercial setting. For example, in residential settings, at least three different sizes of the air vent 10 may be used, which correspond to the three most common air duct outlet sizes used in residential homes.

Figure 3:
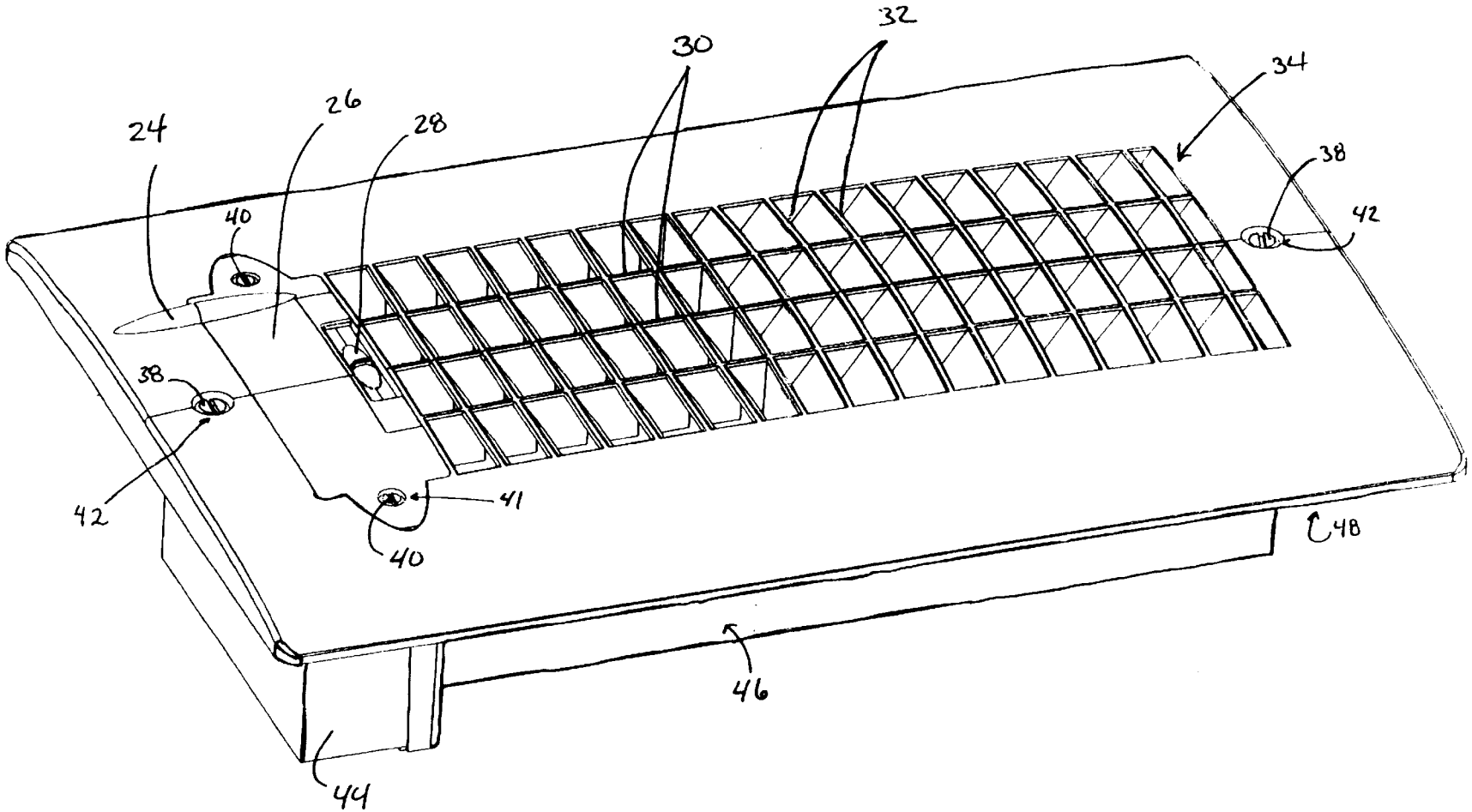
FIG. 3 is an exterior front perspective view of a computer-controlled air vent, according to one embodiment of the invention.

FIG. 3 and following illustrate one embodiment of a computer-controlled air vent 10 and the various component parts thereof. It will be appreciated that the embodiment shown is illustrative only, and that various other configurations included within the subject matter of the present invention are possible, but are not included here in order not to overcomplicate the invention.

FIG. 3 is a front perspective view of a computer-controlled air vent 10, according to one embodiment of the invention. The computer-controlled air vent 10 includes a top plate 36, a base 46, and a component housing 44. Each of these major components is formed of a rigid material, such as plastic, wood, or metal. The component housing 44 is detachable from the generally rectangular-shaped base 46. When viewed from the top or bottom, the base 46, like the top plate 26, has a hollow, generally rectangular shape.

Figure 4:
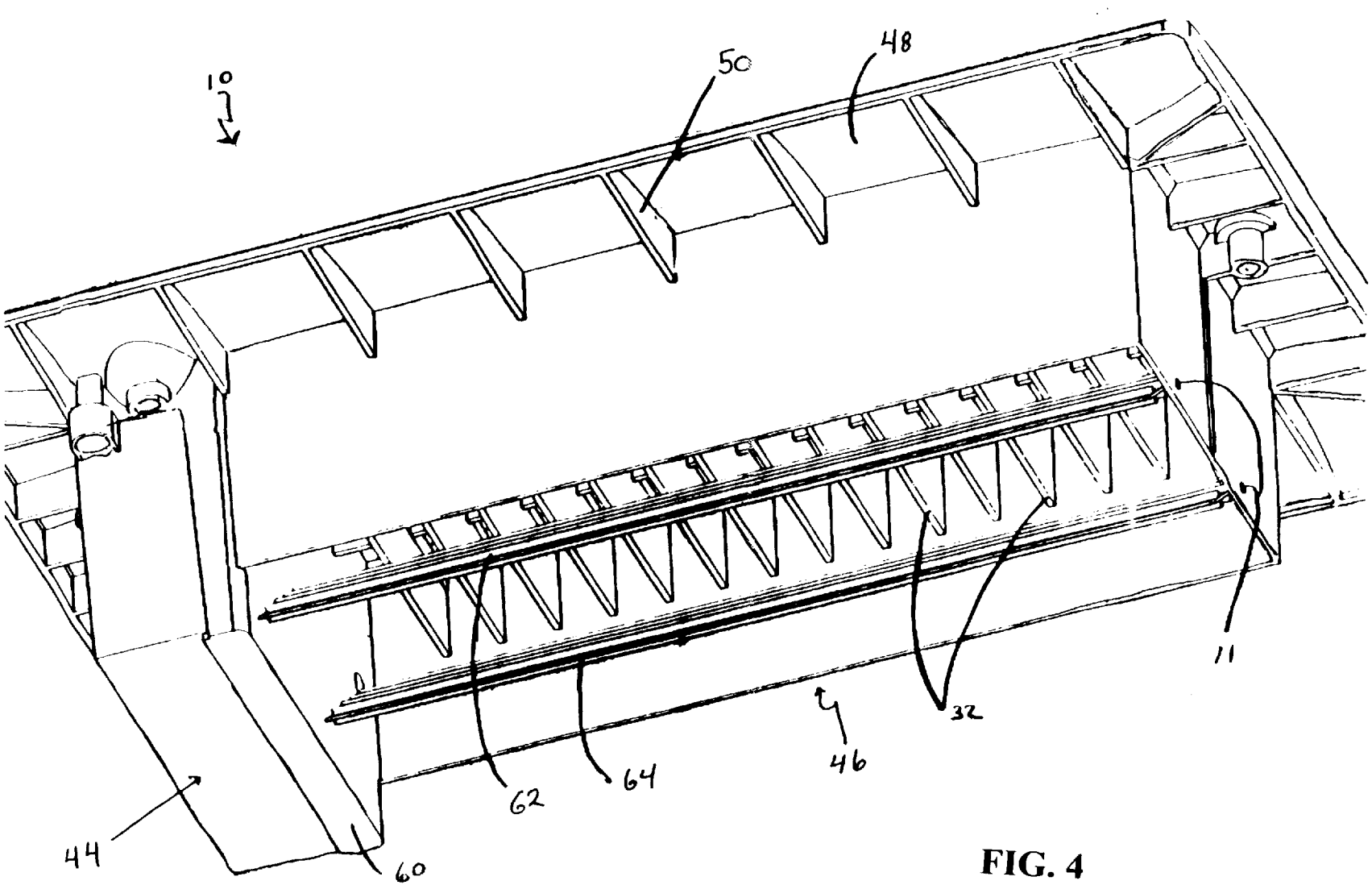
FIG. 4 is a bottom perspective view of the computer-controlled air vent of FIG. 3, according to one embodiment of the invention.

Fixedly or removably attached to the base 46, the top plate 26 is larger than the base 46 and has a curved top surface that bows gently downward and outward from the longitudinal center axis 61 towards the edge portions 63, as shown in FIG. 6. Portions of the top plate 26 that overhang the base 46 form the flange 48, which was previously referenced in FIG. 2. The flange 48 may include one or more support ribs 50, as shown in FIG. 4. Alternatively, the flange 48 may include no support ribs at all.

Twin circular recesses 42 are formed in at either end of the top plate along the top plate's central longitudinal axis. Fasteners 38 in the form of screws fit though the recesses 42 to secure the air vent 10 to the air duct outlet 31, as previously described.

The grill 34 is a slatted, generally-rectangular air channel formed through the top plate 36. The orthogonal intersection of the grill elements 32 and the stiffening bars 30 creates a square grid which diffuses air flowing through the air vent 10. In embodiments of the invention where the air vent 10 is designed to be mounted on the floor, the grill elements 32 are manufactured to have an angled top portion 68 and a straight lower portion 70, as shown in FIG. 6. In such an embodiment, the straight lower portion extends approximately ⅓ or greater into the depth of the base 46. The combination of the angled portion 68 and the length of the straight lower portion 70 provide the rigidity and durability the top plate 36 needs to withstand the weight of an adult user without breaking. Computer-controlled air vents 10 designed to be mounted in walls or ceilings may have smaller grill elements 32.

A bubble 24 formed in a portion of the top plate 36 may house a wireless antenna or a temperature sensor.

A removable component housing cover 26 is positioned adjacent one side of the grill 34. A circular recess 40 is formed at each end of the component housing cover, and fasteners 41 in the form of screws fit through each recess 40 to detachably secure the component housing cover 26 to the air vent 10. The component housing cover 26 may be removed to program the air vent 10 and/or to replace one or more batteries housed within the component housing 44.

As shown in FIG. 3, one embodiment of the invention includes a manual override switch 28 positioned between the grill 34 and the component housing cover 26. Air louvers disposed within the base 46 are opened when the manual override button is slid in one direction and are closed when the button is slid in the opposite direction. The manual override button 28 may be omitted in other embodiments of the invention.

Figure 5:
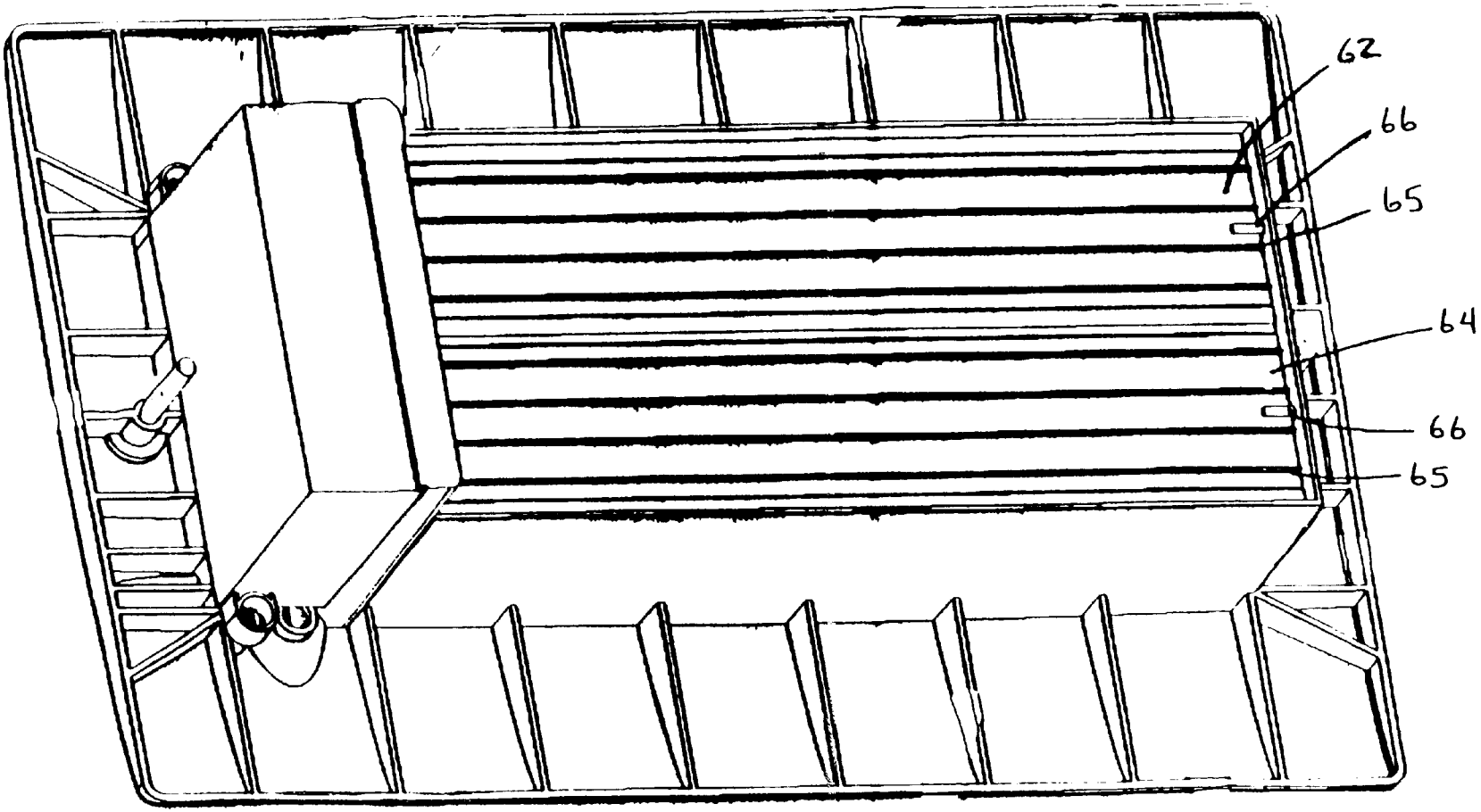
FIG. 5 is another bottom perspective view of the computer-controlled air vent of FIG. 3, according to one embodiment of the invention.
Figure 5:
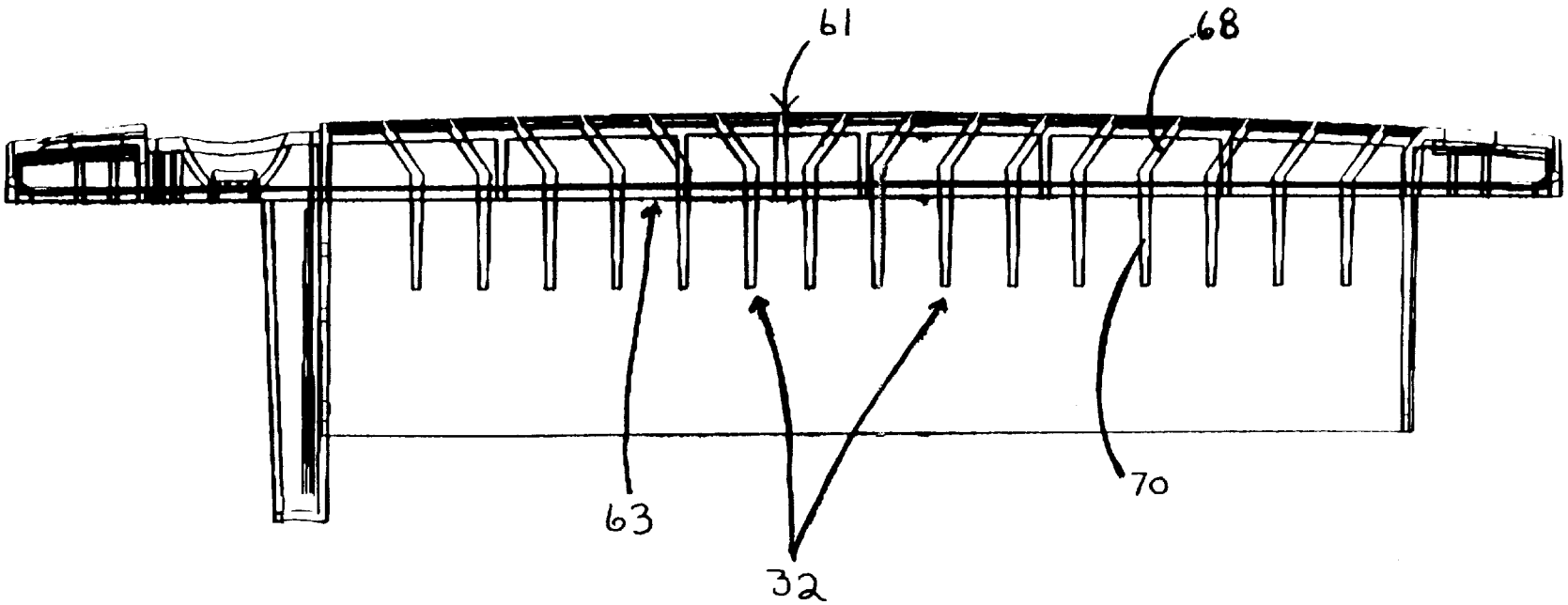

FIG. 4 is a bottom perspective view of the computer-controlled air vent 10 of FIG. 3 further illustrating the base 46, the optional support ribs 50, the flange 48, the grill elements 32, and the component housing 44. As shown, a pair of air louvers 62 and 64 are horizontally disposed within a bottom portion of the base 46. The air louvers 62 and 64 are generally rectangular in shape and include one or more raised support ridges 65 (FIG. 5) extending along the lengths thereof. Pivots 66 (FIG. 5) centrally positioned in the first ends of the air louvers 62 and 64 rotatably fit within circular recesses 71 formed in an end wall 58 of the base 46. Shafts centrally positioned in the other ends of the air louvers 62 and 64 extend through circular recesses formed in an end wall 60 of the component housing 44. The air louvers 62 and 64 are shown in an open position in FIG. 4 and in a closed position in FIG. 5.

Figure 7:
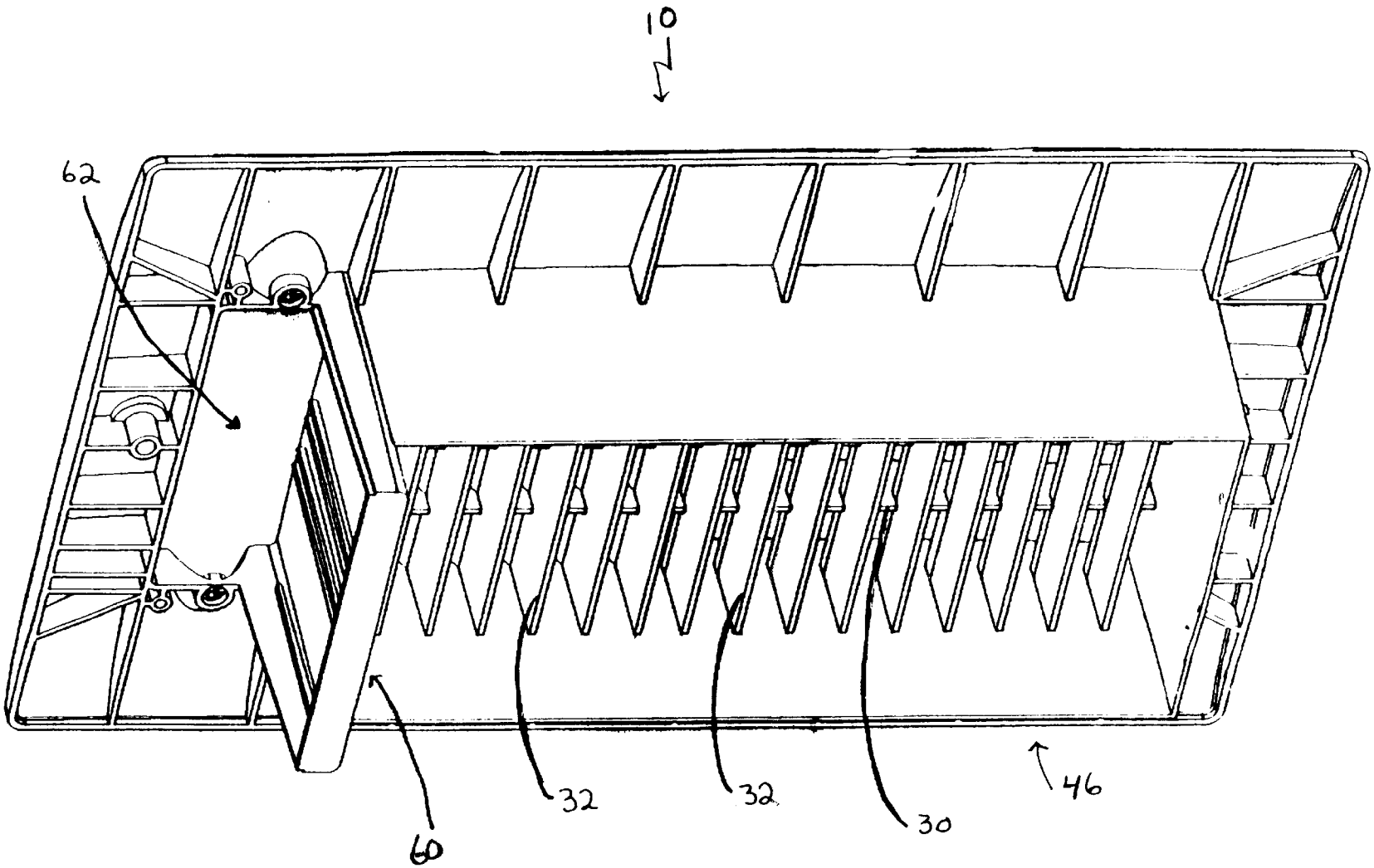
FIG. 7 is another bottom perspective view of the computer-controlled air vent of FIG. 3, according to one embodiment of the invention.

FIG. 7 is a bottom perspective view of the air vent 10, with the component housing 44 and the air louvers 62 and 64 removed. As shown, the support wall 60 forms one end of the base 46 and aligns with one side of the component housing opening 62. Within the base 46, are shown the grill elements 32 and the stiffening bars 30.

Figure 8:
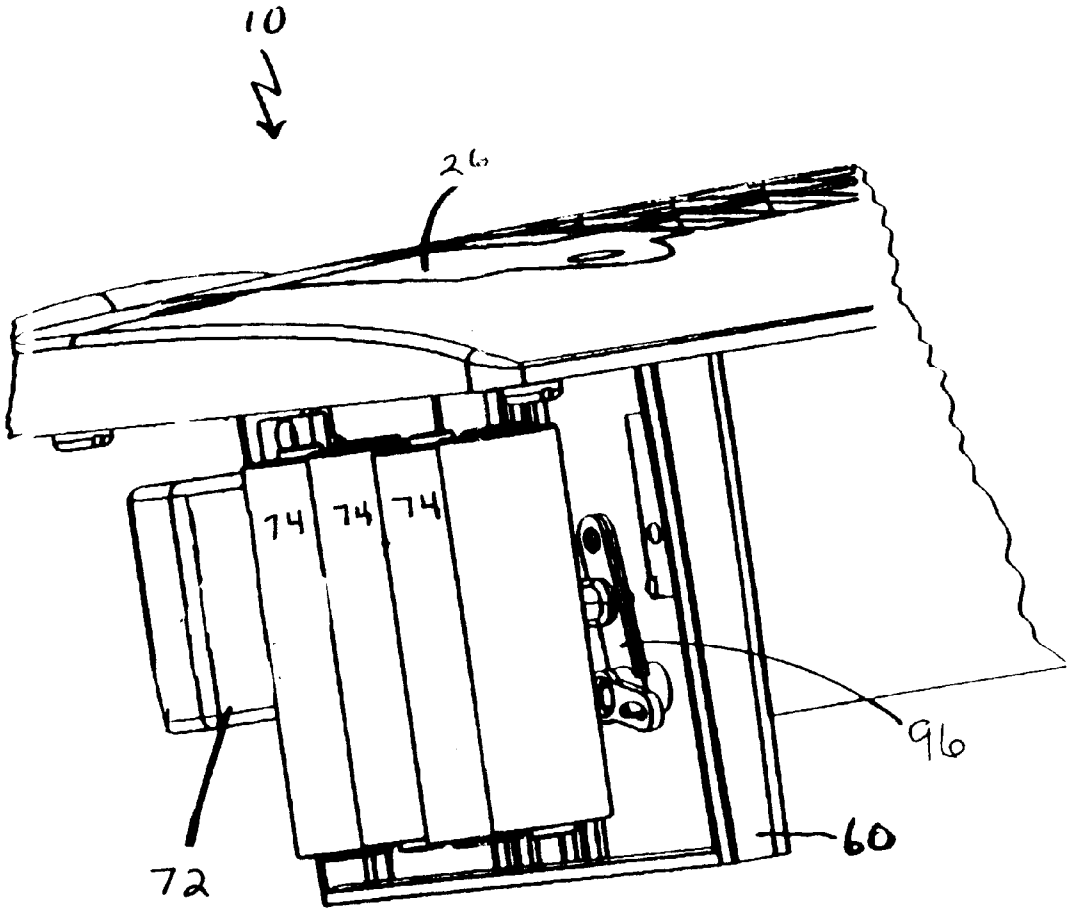
FIG. 8 is a perspective end view of the computer-controlled air vent of FIG. 3, according to one embodiment of the invention.

FIG. 8 is a perspective end view of the computer-controlled air vent 10 of the preceding figures, with the component housing 44 omitted from the drawing to show the electrical, mechanical, and digital components housed within the component housing cavity. Illustratively, such components include a force generating means 72, a power source 74, and cranks 96. The force generating means 72 is mounted to the wall 60 on one side of the component housing cavity, and has a rotatable drive shaft connected to an upper portion of one of the cams 96. The force generating means 72 is further connected to the power supply 74 and communicatively coupled to a computer processor mounted on a printed circuit board (PCB) 114 (shown in FIG. 9), which is positioned behind the power supply 74. When commanded, the force generating means rotates the drive shaft, which also rotates the cams 96 connected to the drive shaft. If the cams 96 rotate clockwise, the louvers 62 and 64 connected to them will pivot into the open position of FIG. 4. If the cams 96 rotate in a counter-clockwise direction, the louvers 62 and 64 will pivot into the closed position of FIG. 5. In one embodiment, the force generating means 72 is a battery operated motor, a stepper motor, or a solenoid. In another embodiment, the force generating means is an artificial muscle of the type known to persons of ordinary skill in the art. For example, an artificial muscle generally is an ionic gel or electro-active polymer that expands and contracts when energized by a current source.

The power source 74 includes one or more disposable or rechargeable batteries that are inserted and removed through the component housing opening 62 shown in FIG. 7. Specifically, before or after the computer-controlled air vent 10 is installed, a user disengages the fasteners holding the component housing cover 26 in place, removes the component housing cover 26, and inserts or removes the batteries 74. The user then repositions the component housing cover 26 and re-engages the fasteners to secure the cover 26 in place.

Figure 9:
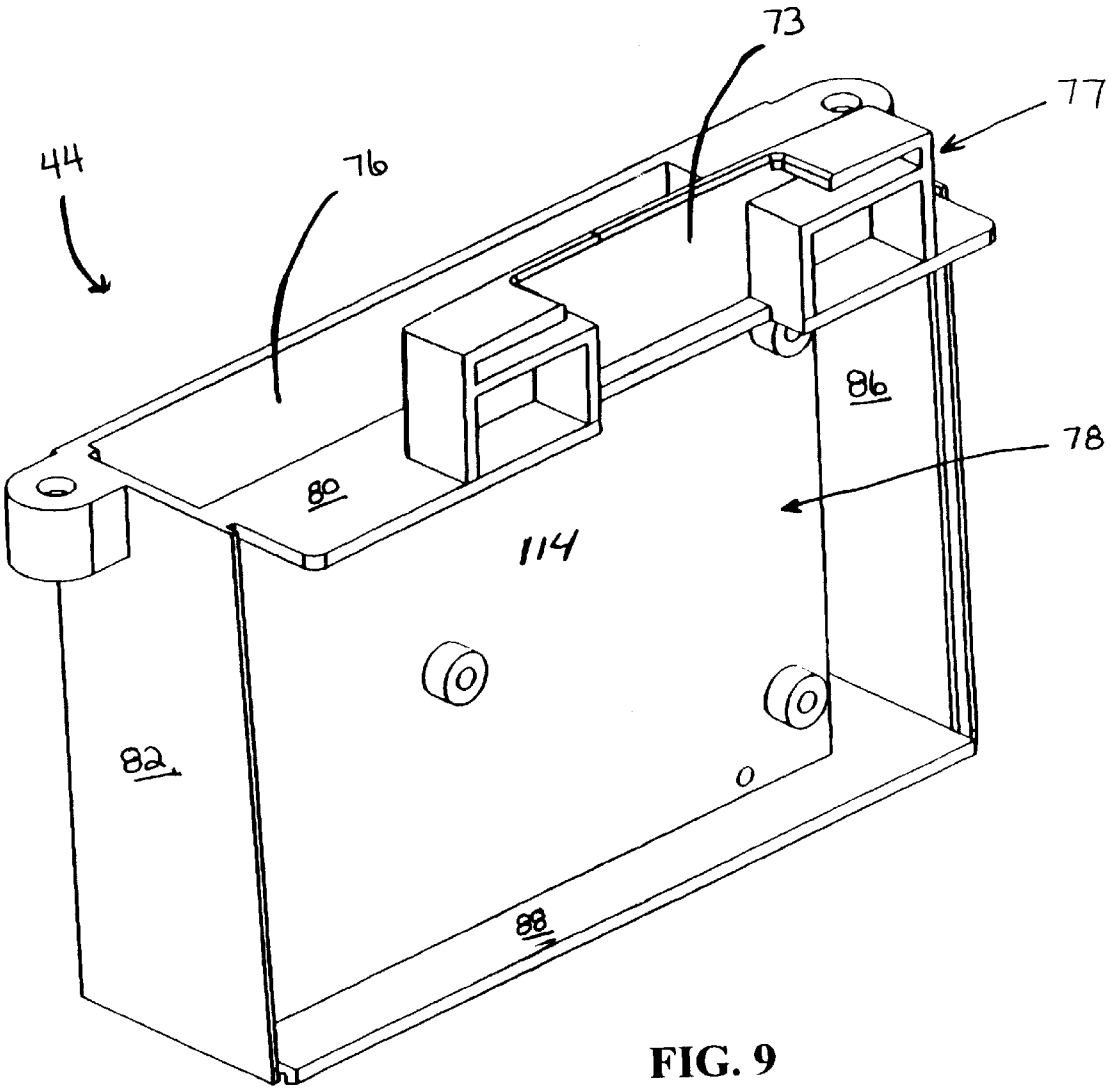
FIG. 9 is a perspective view of one embodiment of a component housing usable with the computer-controlled air vent of FIG. 3, according to one embodiment of the invention.

FIG. 9 is a perspective view of a component housing 44, according to one embodiment of the invention. The component housing 44 is a square-shaped, five-sided member that includes: a top member 80, an opposing bottom member 88, opposing side members 82 and 86, a PCB 114, and a back member (not shown) positioned behind the PCB 114. The front side of the component housing 44 is left open to engage the wall 60, previously described. In effect, the wall 60 forms the front side of the component housing 44, when the component housing 44 is properly installed. A rectangular-shaped recess 76 is formed in the top member 80 to allow insertion and removal of the batteries 74 previously described. In use, the recess 76 is covered by the component housing cover 26, previously described. A manual override switch housing 77 is connected to an upper surface of the top member 80, and includes a recess 73 into which the manual override is slidably inserted. Within the cavity 78, the various electrical, digital, and mechanical components previously described are arranged.

Figure 10:
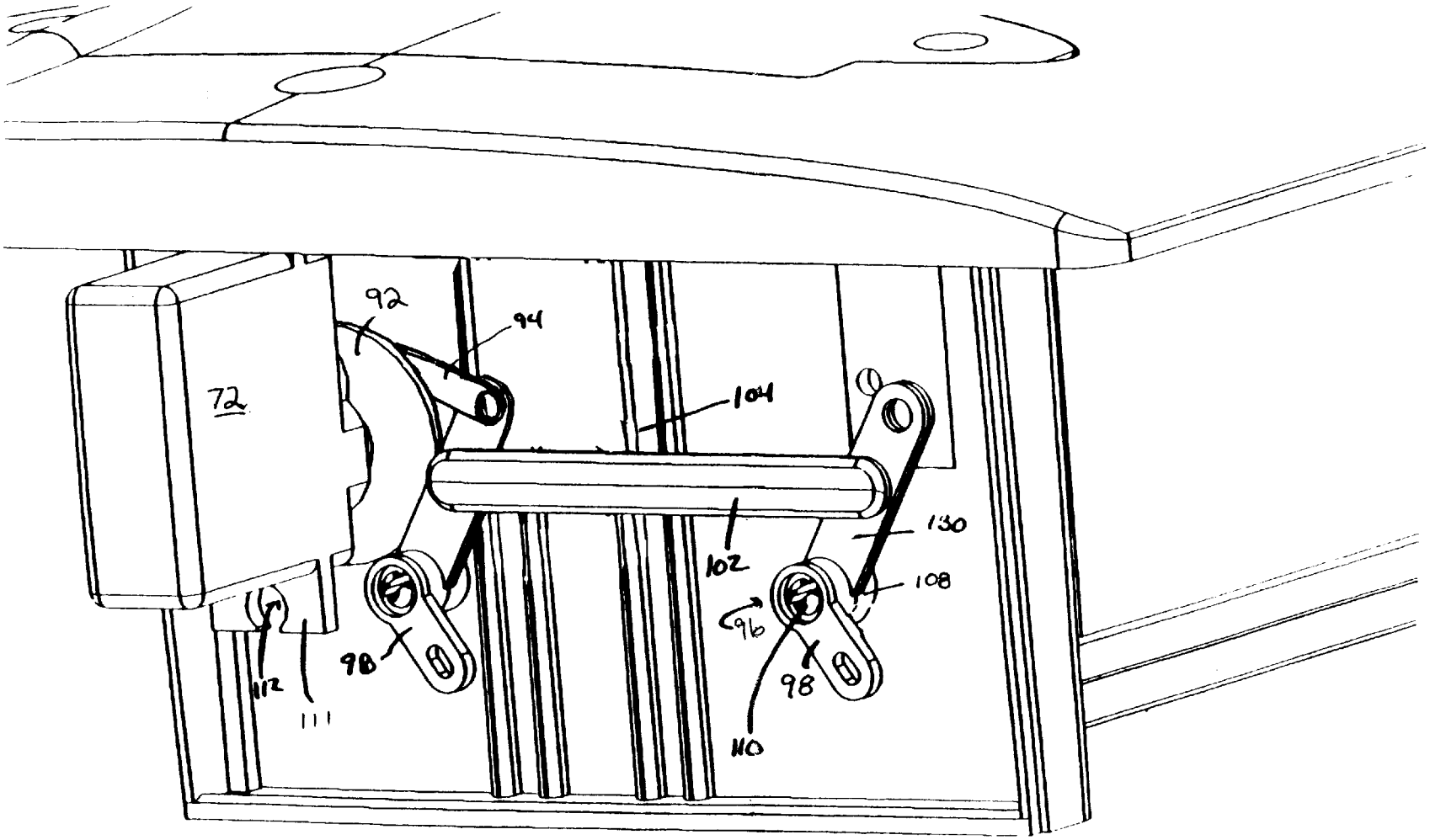
FIG. 10 is an end perspective view of a mechanical linkage assembly used to rotate airflow louvers housed within the computer-controlled air vent of FIG. 3, according to one embodiment of the invention.

FIG. 10 is an end perspective view of the mechanical linkage used to rotate the louvers 62 and 64 between an open and a closed position. As previously described, the linkage includes a motor 72 having a rotatable drive shaft 92 connected to the upper portion 130 of a cam 96 by a linkage bar 94. The cams 96 are linked by the horizontal driver bar 102. The cams 96 further include a hollow cylindrical base portion 108 and a lower arm 98. Additionally, the force generating means 72 includes a housing having flanges 111 at the top and bottom ends. Recesses 112 formed within the flanges receive fasteners that connect to the wall 60 to support the motor 72 in a desired position.

Figure 11:
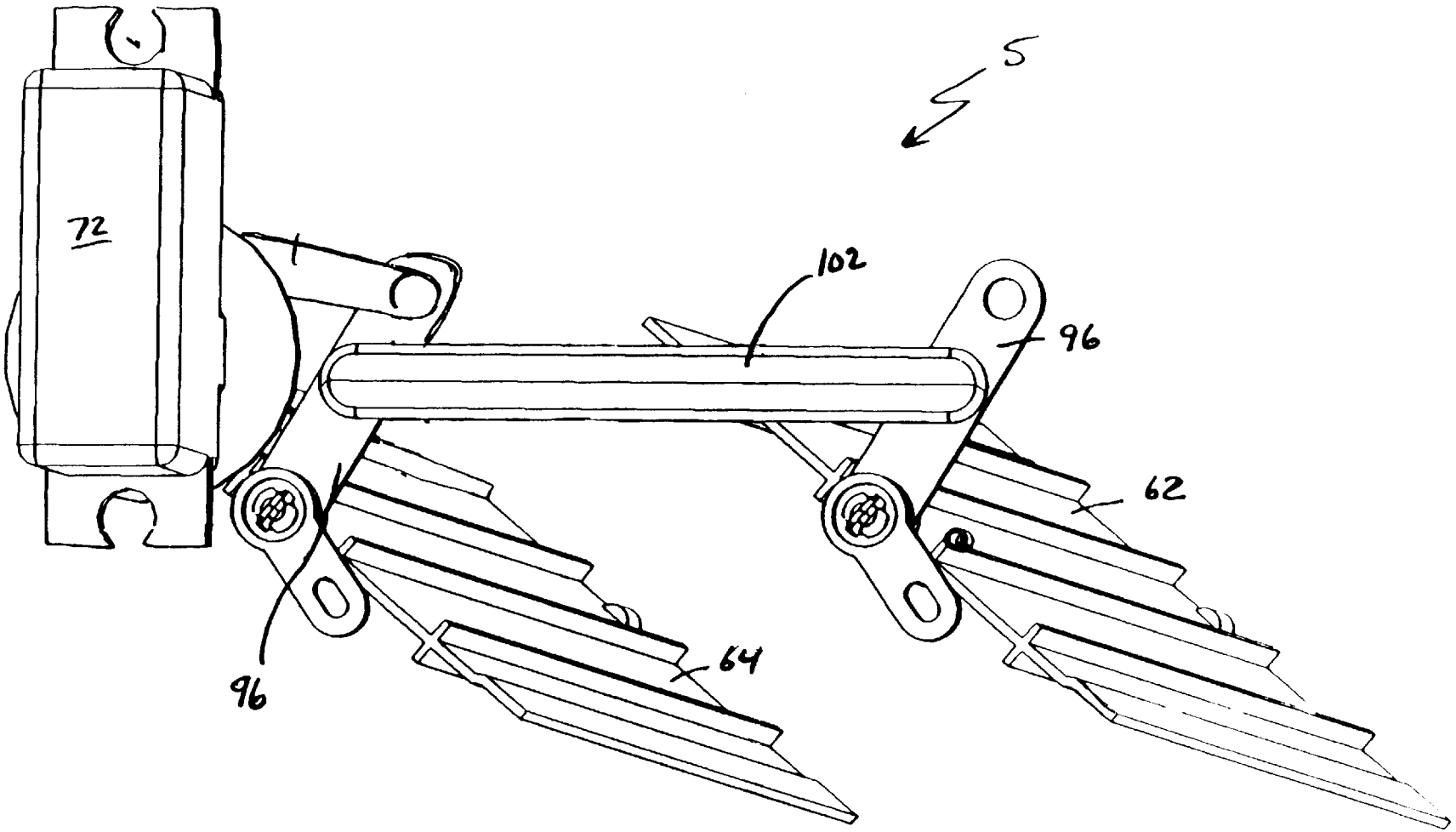
FIG. 11 is a perspective view of a louver assembly in an open position, according to one embodiment of the invention.

FIG. 11 is a perspective view of a louver assembly 5, according to one embodiment of the invention. The louver assembly 5 is shown in an open position and includes the louvers 62 and 64, the driver bar 102, the cams 96, and the motor 72, as previously described.

Figure 12D:
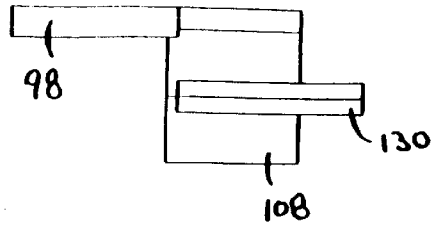
FIG. 12D is a plan view of the cam of FIG. 11, according to one embodiment of the invention.
Figure 12A:
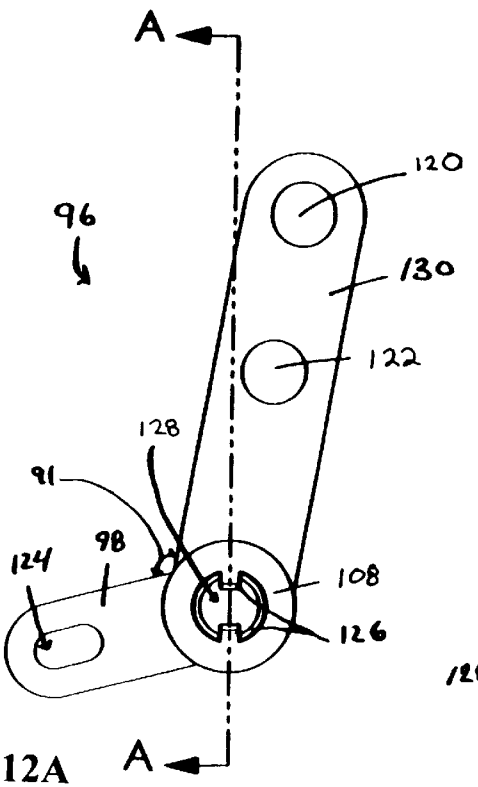
FIG. 12A is a side view of a cam used to rotate the louver assembly of FIG. 11, according to one embodiment of the invention.

FIGS. 12A–12D are side, cross-sectional, end, and top views of a cam 96, according to an embodiment of the present invention. FIG. 12A is a side view of the cam 96, which includes a cylindrical base member 108, an upper portion 130, and a lower portion 98. When viewed from the side as shown in FIG. 12A, the cam 96 is substantially L-shaped, with the upper portion angling upwards and to the right of center, and the lower portion angling downwards and to the left of center. A recess 120 formed in the free end of the upper portion 130 connects to the linkage bar 94 previously described. A recess 122 formed just above a midpoint of the upper portion 130 connects to the driver bar 102, previously described. An opening 128 is formed through the interior of the base 108 and includes two opposing ridge members 126 that protrude into the interior of the opening 128. The upper and lower portions 130 and 98 are separated by an angle 91 of approximately 120 degrees.

Figure 12B:
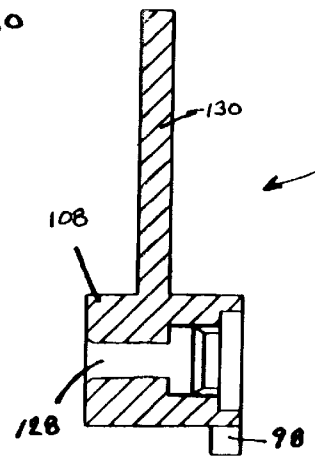
FIG. 12B is a cross-sectional side view of the cam used to rotate the louver assembly of FIGS. 10 and 11, taken along the line A—A of FIG. 12A, according to one embodiment of the invention.

FIG. 12B is a cross-sectional side view of the cam 96 taken along the line A—A in FIG. 12A, showing the placement of the upper portion 130 relative to the base 108, the opening 128, and the lower portion 98.

Figure 12C:
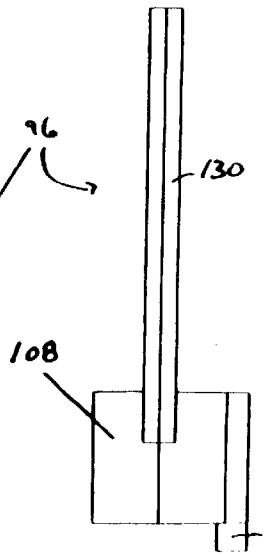
FIG. 12C is an end view of the cam of FIG. 11, according to one embodiment of the invention.

FIG. 12C is an end view of the cam 96, again showing the positioning of the upper portion 130 relative to the base 108 and the lower portion 98.

FIG. 12D is a top view of the cam 96 further showing the geometrical relations between the upper portion 130, the base 108, and the lower portion 98.

The computer-controlled air vent 10 is advantageous for several reasons. First, the air vent 10 may be easily installed in existing HVAC outlet vents without hard-wiring the air vent 10 to a 110 V AC or to a 220 V AC source, or to various DC sources. Second, the computer-controlled air vent 10 accounts for such variables as people and equipment changes, external sun or snow loading, rain, daytime vs. nighttime needs, weekend vs. weekday needs, etc. Although possible to accommodate such changes manually, it is both time-consuming and often impractical for occupants of the structure 16 to repeatedly open and close the air vents by hand. Consequently, without the computer-controlled air vents 10, uneven heating and cooling results, which consumes more energy than is needed to maintain a comfortable environment.

Third, the computer-controlled air vent 10 works in conjunction with a central thermostat to cool or heat a structure 16 faster and more efficiently than conventional systems. Specifically, the computer-controlled air vent 10 distributes temperature-controlled air (the temperature of which is regulated by the thermostat) evenly to all areas of a structure (e.g. closing air vents when an area reaches a target temperature to redirect the temperature-controlled air to other areas of the structure that need it). This translates to significant energy savings.

Figure 13:
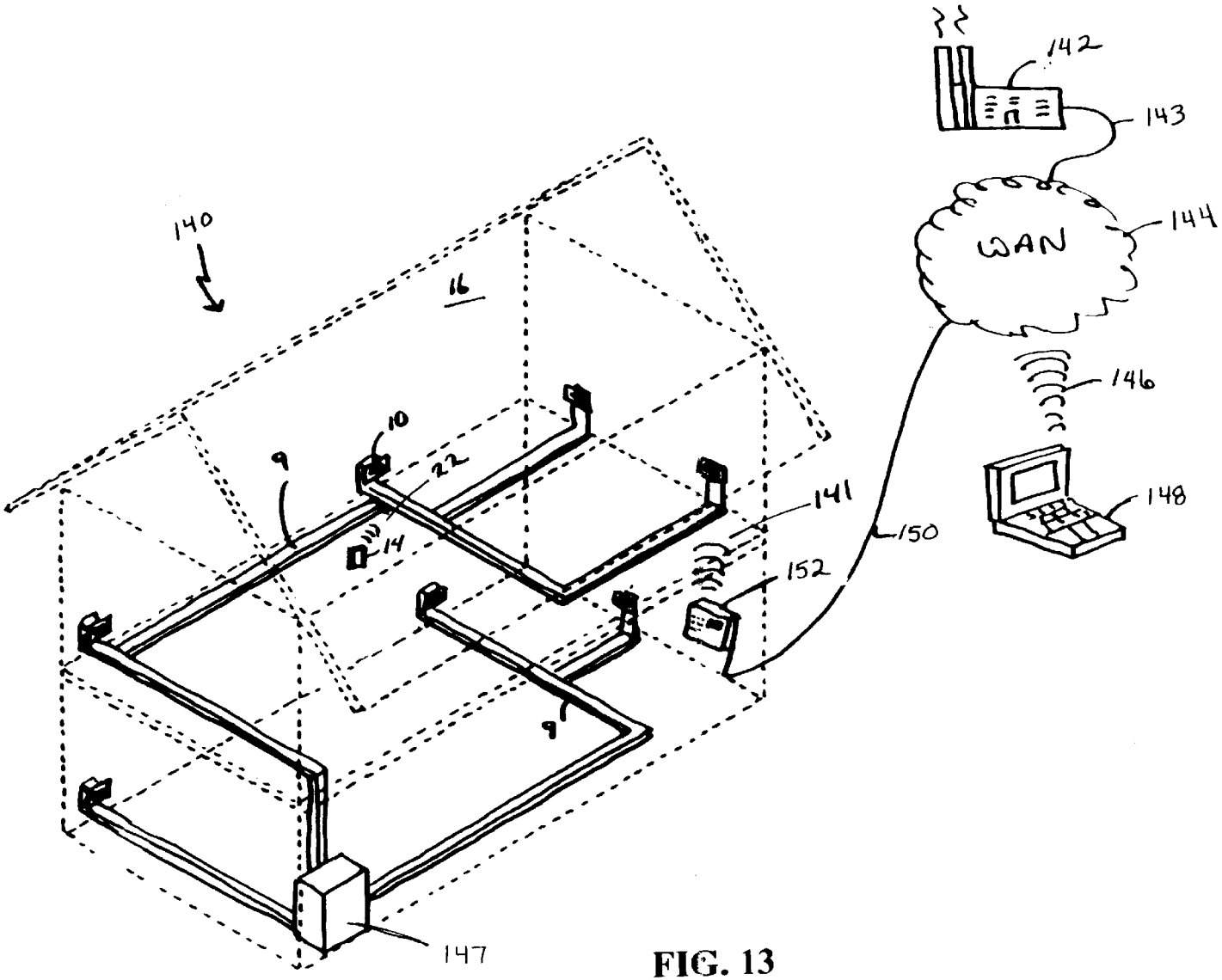
FIG. 13 is a perspective view of a temperature adjustment system that includes a plurality of networked computer-controlled air vents, according to one embodiment of the invention.

FIG. 13 is a perspective view of a system 140 for adjusting the temperature within a structure 16. The system includes at least one computer-controlled air vent 10, which is removably attached to an air duct outlet vent, and a corresponding handheld or wall-mounted remote controller 14, as previously described. The remote controller 14 is connected to the air vent 10 via the wireless communications channel 22. A HVAC unit 147 blows conditioned heated or cooled air through the air ducts 9 that run throughout the walls, floors, and ceilings of the structure 16. The system 140 also includes a master controller 152, connected to the remote controller 14 via the wireless communication channel 141. The master controller 152 is connected to a computer network 144 such that a user of a portable computer 148 or a utility company 142 can selectively program the remote controller 14 from a separate geographical location. In one embodiment, the computer network 144 is a wide area network (WAN) such as the Internet. In another embodiment, the computer network 144 is a local area network (LAN). The communications links 143, 146, and 150 may be physical cables in the form of a high speed fiber optic lines or DSL telephone lines. Alternatively, the communications links 143, 146, and 150 may be wireless communications channels.

In one embodiment, a power company 142 monitors energy consumption for one or more power grids and, from a remote geographical location, adjusts a target temperature in one or more remote controllers 14 (and master controllers 152) that are located in the homes or commercial buildings of participating users. Additionally, the power company 142 is configured and communicatively coupled to a structure's central thermostat to adjust a target temperature of the thermostat upwards or downwards. For example, target temperatures in one or more structures 16 may be adjusted upward a few degrees on hot days, or adjusted a few degrees downward on cold days. For example, the force generating means may open the louvers when the ambient air temperature and the inputted target temperature differ by a temperature of more than approximately 1.0 degrees Fahrenheit. Alternatively, the force generating means may close the louvers when the ambient air temperature and the inputted target temperature differ by a temperature of less than approximately 1.0 degrees Fahrenheit. These adjustments may be made manually or automatically in near real-time, and the target temperatures may be the same for all structures within a particular power grid or different for each structure. A time duration may be specified to limit the time the power company override remains in effect.

The new target temperature (together with day/time/week information) is transmitted over the communications links 143 and 150 to the master controller 152, which relays the new target temperature to the remote controller 14. Once the new target temperature (and/or day/time/week information) is received, the remote controller 14 operates as previously described.

In a similar fashion, an individual user of the personal computer 148 can adjust the target temperature (and/or day/time/week information) of a remote controller 14 upwards or downwards by inputting the new target temperature (and/or day/time/week) information into the personal computer 148 and transmitting the same over the communications links 146 and 150 to the master controller 152, which then relays the inputted information to the remote controller 14.

The personal computer 148 may be a laptop computer, such as a G4 Powerbook™ manufactured by Apple Computer of Cupertino, Calif. Alternatively, the personal computer 148 may be a handheld device, such as a Palm OS organizer or a mobile phone.

In another embodiment, a user can use the master controller 152 to adjust the target temperatures (and/or day/time/week information) of one or more remote controllers 14. This embodiment is particularly advantageous where a plurality of remote controllers 14 are used within a single structure. In such an embodiment, the remote controllers 14 each transmit their respective actual and target temperatures (and/or day/time/week information) to the master controller over the communications channel 141. These actual and target temperatures (and/or day/time/week information) are displayed for the user on a display device connected to the master controller 152. Using an input device connected to the master controller 152, the user can modify one or more of the target temperatures (and/or one or more of the day/time/week groupings). Once inputted, the new settings are transmitted from the master controller 152 to the respective remote controllers 14. Thereafter, the remote controllers operate as described above.

Figure 14:
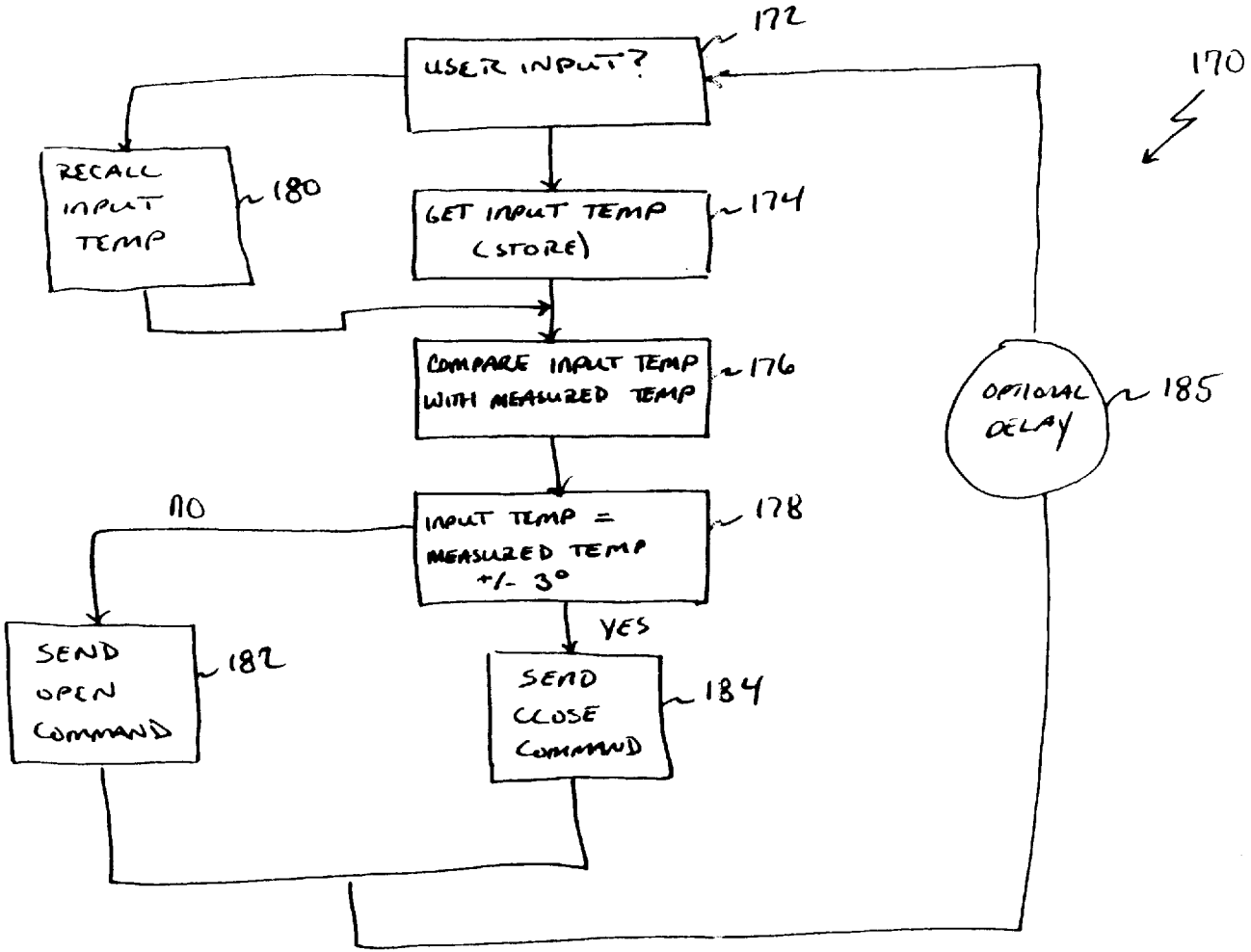
FIG. 14 is a flowchart illustrating an algorithm used by the remote control device, according to one embodiment of the invention.

FIG. 14 is a flowchart illustrating one embodiment of an algorithm used by the remote control device 14 of FIG. 1. The algorithm 170 begins at block 172, where it is determined whether a user input is received. If no user input is received, the remote control device 14 recalls a previously input target temperature (Block 180). If a user input is received, the remote control device 14 gets the inputted target temperature and stores it in a memory device located in the remote control device 14 (Block 174). Thereafter, a temperature sensing device located in the remote control device 14 provides a measured ambient air temperature of the room in which the remote control device 14 is located. A comparator in the remote control device 14 compares the input target temperature with the measured temperature (Block 176). If the measured temperature is equal to the input target temperature +/− approximately 3.0 degrees, the remote control device 14 sends a close command to the computer-controlled air vent 10, which causes the force generating means to close the air louvers. If the measured temperature is not equal to the input target temperature +/− approximately 3.0 degrees, the remote control device 14 sends an open command to the computer-controlled air vent 10, which causes the force generating means to open the air louvers. Thereafter, the algorithm 170 loops back to block 172. An optional delay 185 may be included in the circuitry and logic of the remote control device 14 so that only periodic and not constant checks are made.

As described above, one embodiment of the present invention includes an active louver positioning mechanism integrated within the vent 10 and includes a programmable control element 18 that recognizes the time of day, day of the week, and room temperature. The control element 18 can reside in the computer-controlled air vent 10 or remotely in the room in which the vent 10 is installed. The control element 18 provides a "close" or "open" signal to the louver positioning mechanism at the appropriate time(s) based on the control element's detection of time and the interior temperature. Both the louver positioning mechanism and the control element can potentially use power from a number of sources in the structure 16. Illustratively, such power sources include airflow and electrical sources.

Because a plurality of computer-controlled air vents 10 can be installed within a structure, each vent 10 is manufactured and configured to network with other computer-controlled air vents 10 and/or a master controller 152 configured to manage facility-wide environmental systems. The master controller 152 connects to a WAN in the form of the Internet to proved worldwide, real-time access to multiple facilities. Illustratively, this permits global control of an entire corporation for the optimization of energy usage and/or the remote servicing of internal customers. With such a system, corporations can react to energy rate changes on a real-time basis and work closely with energy providers to prevent shortages at peak periods of energy usage. In residential cases, the Internet link is used for power grid level control of energy consumption. Illustratively, residential customers are provided with a price discount for allowing an energy provider to have partial control of their heating and/or cooling systems, which aids significantly in reducing energy shortages.

Embodiments of the present invention are applicable virtually anywhere a central heating/cooling system having multiple output points is used in a structure.

One embodiment of a computer-controlled air vent 10 includes air deflection elements 32, a louver control and actuation system 140, a surrounding rim 48, and the louvers 62 and 64 themselves. The rim 48 supports the vent 10 in a wall, floor, or ceiling. The air deflection elements 32 diffuse temperature-controlled air flowing through the vent 10. The louver control and actuation system 140 monitors temperature, time, and a plurality of computer-controlled vents 10 on a local (or global) network. It also performs the closing and opening operations of the louvers 62 and 64 at the appropriate times. The surrounding rim 48 serves as a mounting surface for the register to cover the ducting port 31 into the room of interest. Elements of the system 140 are programmed by a user 12 to control the room temperature at certain times and to potentially block substantially all airflow into a room if it is not in use at other times. The computer-controlled air vent 10 can report its operational status, room temperature, and programming to a network that uses additional computers for both reporting and overall facility control purposes.

Although the present invention is described herein with reference to a specific preferred embodiment, many modifications and variations therein will readily occur to those with ordinary skill in the art. Accordingly, all such variations and modifications are included within the intended scope of the present invention as defined by the following claims.

What is claimed is:

1. A computer-controlled air vent, comprising:

a base;

a plurality of louvers disposed within the base, the louvers to block a flow of air through the base when the louvers are in a closed position and to permit a flow of air through the base when the louvers are in an open position;

a printed circuit board (PCB) attached to the base;

force generating means electrically connected to a first computer processor and to a power source, and mechanically connected to the plurality of louvers, the force generating means to open and close the plurality of louvers in response to signals received from the first computer processor;

a first wireless transceiver attached to the base and connected to the first computer processor;

the power source attached to the base and connected to the force generating means to provide power to the force generating means; and a second computer processor positioned in a remote control device and connected to a second wireless transceiver in the remote control device to transmit command signals to the first wireless transceiver.

2. The computer-controlled air vent of claim 1, wherein each of the plurality of louvers is a rectangular-shaped, planar member that includes a plurality of reinforcement ribs extending longitudinally along a length thereof.

3. The computer-controlled air vent of claim 2, wherein each of the plurality of louvers further comprises:

a first pivot centrally connected to a first end of each louver, the pivot to rotate within an opening formed in an end wall of the base;

a shaft centrally connected to a second end of each louver, wherein the shaft protrudes through an opposite end wall of the base to connect to a cam that is connected to the force generating means.

4. The computer-controlled air vent of claim 3, wherein the power source further includes:

a receptacle within the base;

a plurality of electrical contacts positioned within the receptacle to receive one or more batteries.

5. The computer-controlled air vent of claim 4, further comprising:

a top plate attached to the base;

a removable component housing cover formed in the top plate and secured to the top plate by rotatable fasteners.

6. The computer-controlled air vent of claim 5, wherein the rotatable fasteners remain with the component housing cover after the fasteners are disengaged from the top plate.

7. The computer-controlled air vent of claim 3, further comprising:

a master controller having a third wireless transceiver positioned therein and configured to transmit data and command signals to the computer processor, wherein the master controller is connected to a computer network.

8. The computer-controlled air vent of claim 7, further comprising:

a power company computer server connected to the computer network and configured to transmit data and command signals to the master controller over the computer network.

9. The computer-controlled air vent of claim 7, further comprising:

a handheld device connected to the computer network and configured to transmit data and command signals to the master controller over the computer network.

10. The computer-controlled air vent of claim 9, wherein the remote control device is positioned in a same room as the air vent.

11. The computer-controlled air vent of claim 10, further comprising:

a temperature sensing device positioned in the remote control device.

* * * * *